US012590410B2

(12) United States Patent
Zhang et al.

(10) Patent No.: US 12,590,410 B2
(45) Date of Patent: Mar. 31, 2026

(54) EMBOSSABLE NON-SOLVENT PU SHEET, A LAMINATE AND A SYNTHETIC LEATHER COMPRISING THE SAME

(71) Applicant: BASF SE, Ludwigshafen am Rhein (DE)

(72) Inventors: Zhong Kai Zhang, Shanghai (CN); Feng Qin, Shanghai (CN); Hang Yu Xu, Shanghai (CN); Chun Yi Chen, Shanghai (CN)

(73) Assignee: BASF SE, Ludwigshafen am Rhein (DE)

( * ) Notice: Subject to any disclaimer, the term of this patent is extended or adjusted under 35 U.S.C. 154(b) by 402 days.

(21) Appl. No.: 18/251,047

(22) PCT Filed: Oct. 13, 2021

(86) PCT No.: PCT/EP2021/078353

§ 371 (c)(1),
(2) Date: Apr. 28, 2023

(87) PCT Pub. No.: WO2022/100950

PCT Pub. Date: May 19, 2022

(65) Prior Publication Data

US 2024/0328079 A1 Oct. 3, 2024

(30) Foreign Application Priority Data

Nov. 13, 2020 (WO) ..... PCT/CN2020/128628

(51) Int. Cl.
*D06N 3/18* (2006.01)
*D06N 3/00* (2006.01)
*D06N 3/14* (2006.01)

(52) U.S. Cl.
CPC ..... *D06N 3/183* (2013.01); *D06N 3/0077* (2013.01); *D06N 3/14* (2013.01); *Y10T 428/24438* (2015.01)

(58) Field of Classification Search
CPC ..... D06N 3/183; D06N 3/0077; D06N 3/14; Y10T 428/24438
See application file for complete search history.

(56) References Cited

U.S. PATENT DOCUMENTS

2008/0214727 A1 9/2008 Pohl et al.

FOREIGN PATENT DOCUMENTS

CN 104032587 A 9/2014
CN 203938912 U 11/2014
(Continued)

OTHER PUBLICATIONS

[NPL-1] Ma et al. (CN 110128614 A); Aug. 16, 2019 (European Patent Office machine translation to English). (Year: 2019).*
(Continued)

*Primary Examiner* — Donald M Flores, Jr.
(74) *Attorney, Agent, or Firm* — Armstrong Teasdale LLP

(57) ABSTRACT

Described herein is an embossable non-solvent polyurethane sheet, which is formed from a non-solvent polyurethane system including a polyol component (a) and an isocyanate component (b), where the polyol component (a) includes (a-1) at least one polyol having a functionality in a range of from 1.5 to 2.5; and (a-2) optionally at least one polyol having a functionality in a range of 2.7 to 3.5, wherein an amount of the at least one polyol (a-2) is ≤6 wt %, based on a total weight of the polyol component (a), and wherein the polyol component (a) has an average functionality of from 1.5 to 2.1. Also described herein are a laminate including the sheet and a synthetic leather including the sheet. Also described herein are a method of using the sheet, a method of using the laminate, and a method of using the synthetic leather.

18 Claims, 2 Drawing Sheets

(56) References Cited

FOREIGN PATENT DOCUMENTS

| | | | | | |
|---|---|---|---|---|---|
| CN | 106519177 | A | | 3/2017 | |
| CN | 108467472 | A | * | 8/2018 | ..... C08G 18/698 |
| CN | 109957092 | A | | 7/2019 | |
| CN | 110128614 | A | * | 8/2019 | ..... C08G 18/3206 |
| CN | 111016310 | A | | 4/2020 | |
| WO | 2006097508 | A1 | | 9/2006 | |
| WO | WO-2021209284 | A1 | * | 10/2021 | ..... D06N 3/0095 |

OTHER PUBLICATIONS

[NPL-2] Min et al. (CN 108467472 A); Aug. 31, 2018 (European Patent Office machine translation to English). (Year: 2018).*

Database WPI, Week 201871, Thomson Scientific, retrieved from WPI Database accession No. 2018-70068P, XP002805347, Aug. 31, 2018, 3 pages.

Database WPI, Week 201969, Thomson Scientific, retrieved from WPI Database accession No. 2019-59871F, XP002805348, Jul. 2, 2019, 4 pages.

Database WPI, Week 201972, Thomson Scientific, retrieved from WPI Database accession No. 2019-727421, XP002805346, Aug. 16, 2019, 4 pages.

Zhang, et al., Unpublished PCT Patent Application No. PCT/CN2020/084834, filed on Apr. 15, 2020, titled "A laminate comprising aqueous polyurethane dispersion and 2-component polyurethane and the use thereof", 18 pages.

International Search Report and Written Opinion for corresponding PCT/EP2021/078353 mailed Jan. 28, 2022; 11 pages.

* cited by examiner

EMBOSSABLE NON-SOLVENT PU SHEET, A LAMINATE AND A SYNTHETIC LEATHER COMPRISING THE SAME

CROSS-REFERENCE TO RELATED APPLICATIONS

This application is a U.S. National Phase Application of PCT/EP2021/078353, filed Oct. 13, 2021, which claims the benefit of priority to PCT/CN2020/128628, filed Nov. 13, 2020, the entire contents of which are hereby incorporated by reference herein.

TECHNICAL FIELD

The present invention relates to an embossable non-solvent polyurethane sheet, which is formed from non-solvent polyurethane system comprising a polyol component (a) and an isocyanate component (b), and a laminate and a synthetic leather comprising the same.

BACKGROUND

Non-solvent PU synthetic leather is one of eco-friendly solutions for synthetic leather industry. It normally needs aqueous dispersions to form top coat layer and non-solvent polyurethane sheet to form base coat layer. According to the requirements of the application, some synthetic leather need have embossing pattern, and whether the pattern can be obtained mainly depends on the property of the non-solvent polyurethane sheet. However, normal thermosetting/cross-linked PU system that is commonly used for synthetic leather almost is impossible to be embossed, even under very high embossing temperature, such as at a temperature of 180° C. to 220° C.

WO2006/097508 discloses a method for preparing polyurethane layers for a synthetic leather, wherein the polyurethane layer comprises an isocyanate component (a), a polyol component (b), foamer (c) and filler (d). This patent discloses multiple raw materials suitable for the isocyanate component (a) and the polyol component (b); however, it does not involve the texture duplicate property of the polyurethane layer.

CN203938912U discloses an embossable non-solvent synthetic leather comprising of PU top layer, thermoplastic polyurethane foam intermediate layer and thermoset polyurethane base layer. Specifically, this patent discloses achieving products with good properties and favorable processing performance by adopting the multilayer structure.

CN10403258 discloses a method for producing an embossable non-solvent synthetic leather, which comprises of PU top layer, thermoplastic polyurethane foam intermediate layer and thermoset polyurethane base layer. Specifically, this patent discloses achieving products with good texture and hand feel by adopting the multilayer structure.

CN106519177A discloses a method for producing embossable non-solvent PU synthetic leather. Specifically, this patent discloses using two-component polyurethane to prepare semi-finished products, followed by embossing treatment, to obtain the synthetic leather. However, this patent does not involve the technical problem of how to improve the texture duplicate property of the synthetic leather.

CN111016310A discloses high-durability solvent-free embossing grain-sucking polyurethane synthetic leather. Specifically, this patent discloses using two-component polyurethane foamed resin, especially post curing embossing grain-sucking polyurethane, to prepare the synthetic leather.

Therefore, it is still required to provide new non-solvent polyurethane sheet, which may impart higher texture duplicate, such as more than 55%, to the synthetic leather based on the sheet, while having very sharp and clear embossing pattern.

SUMMARY OF THE INVENTION

An object of this invention is to overcome the problems of the prior art discussed above and to provide an embossable non-solvent polyurethane sheet, which is formed from non-solvent polyurethane system comprising a polyol component (a) and an isocyanate component (b). Meanwhile, the final synthetic leather based on the sheet achieves improved properties in terms of texture duplicate, as well as instant peel strength, curing property and/or flexing endurance. Furthermore, the final synthetic leather can be prepared at lower temperature of 160° C. to 175° C.

Surprisingly, it has been found by the inventors that the above object may be achieved by providing an embossable non-solvent polyurethane sheet, which is obtained from non-solvent polyurethane system comprising a polyol component (a) and an isocyanate component (b), wherein the polyol component (a) comprises (a-1) at least one polyol having a functionality in the range of from 1.5 to 2.5; and optionally (a-2) at least one polyol having a functionality in the range of 2.7 to 3.5; wherein the amount of polyol (a-2) is ≤6 wt %, based on the total weight of the polyol component (a); wherein the polyol component (a) has an average functionality of from 1.5 to 2.1.

In a preferable embodiment of the invention, the polyol (a-1) is a polyol mixture of at least two polyols having a functionality in the range of from 1.5 to 2.5.

In a preferable embodiment of the invention, the amount of polyol (a-2) is in the range of from 0 wt % to 4 wt %, preferably 0 wt % to 3.5 wt %, more preferably 1 wt % to 3 wt %, each based on the total weight of the polyol component (a).

In a preferable embodiment of the invention, at least one polyol of the polyol (a-1) has a functionality in the range of from 1.5 to 2.1.

In a preferable embodiment of the invention, at least one polyol of the polyol (a-2) has a functionality in the range of from 2.7 to 3.5, preferably 2.7 to 3.0.

In a preferable embodiment of the invention, the polyol component (a) has an average functionality of from 1.5 to 2.0, preferably from 1.8 to 2.0, more preferably from 1.9 to 2.0, especially from 1.9 to 1.97.

In a preferable embodiment of the invention, the at least one polyol of polyol (a-1) is selected from polyether polyols derived from epoxides or oxygen-containing heterocyclic compounds comprising 3 to 6 carbon atoms.

In a preferable embodiment of the invention, the at least one polyol of polyol (a-2) is selected from polyether polyols derived from epoxides.

In a preferable embodiment of the invention, the isocyanate component (b) comprises (b-1) isocyanate and (b-2) one or more polyol having a functionality in the range of from 1.5 to 2.5.

In a preferable embodiment of the invention, the polyol (b-2) has a weight-average molecular weight in the range of from 500 g/mol to 5000 g/mol, preferably from 800 g/mol to 3000 g/mol, and OH value in the range of from 20 to 300, preferably from 20 to 150.

Another object of this invention is to provide an embossable non-solvent PU laminate, comprising A) a top coat layer based on an aqueous polyurethane dispersion, and B) a base coat layer underneath the top coat layer, wherein the base coat layer is made of the sheet according to the present invention.

In a preferable embodiment of the invention, the top coat layer of the laminate further contains a crosslinker with a content of from 0.5 to 10%, preferably from 0.5 to 5%, based on the amount of the aqueous polyurethane dispersion, wherein the crosslinker is selected from aromatic- or aliphatic-polycarbodiimide (PCDI) with or without hydrophilic modification, or isocyanate trimer.

In a preferable embodiment of the invention, the aqueous polyurethane dispersion of the top coat layer has onset decomposing temperature in the range from 150-250° C., preferably from 180-230° C., measured by TGA.

Another object of this invention is to provide a synthetic leather which comprising the laminate according to the present invention and a substrate layer, wherein the substrate layer is underneath the base coat layer of the laminate.

Another object of this invention is to provide the use of the sheet, the laminate or the synthetic leather as the upper or covering material in the application of apparel, accessories, cases, electronic devices, furniture, auto upholstery, sports items or leisure products.

It has been surprisingly found that the inventive synthetic leather has improved properties in terms of texture duplicate, peel strength, curing property and/or flexing endurance by using, as base coat layer, innovative embossable non-solvent polyurethane sheet which is formed from a polyol component (a) comprising specific polyols and having specific average functionality.

DETAILED DESCRIPTION OF THE INVENTION

Figure 1:
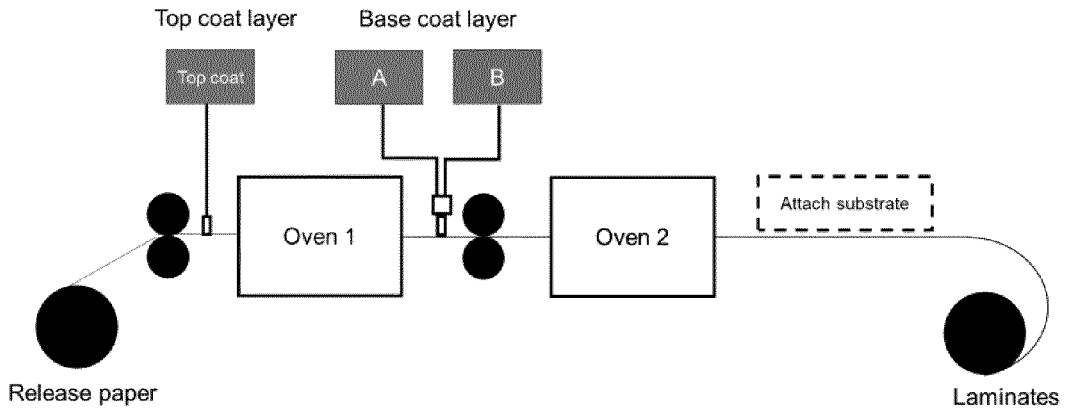
FIG. 1 shows the process for preparing 2-layer Laminates consisting of the top coat layer and the base coat.

Unless defined otherwise, all technical and scientific terms used herein have the meaning commonly understood by a person skilled in the art to which the invention belongs. As used herein, the following terms have the meanings ascribed to them below, unless specified otherwise.

As used herein, the articles "a" and "an" refer to one or to more than one (i.e., to at least one) of the grammatical object of the article or component.

Unless otherwise identified, all percentages (%) are "percent by weight".

Unless otherwise identified, the term "total solid weight" refers to the total weight of the system or the dispersion minus the weight of all the solvents (including water).

Unless otherwise identified, for top coat layer, all the weight percentages (%) of the additives and/or auxiliaries refer to percentages of "the solid weight of the additives and/or auxiliaries divided by total solid weight of the aqueous polyurethane dispersion".

Unless otherwise identified, for base coat layer, all the weight percentages (%) of the additives and/or auxiliaries refer to percentages of "the solid weight of the additives and/or auxiliaries divided by total solid weight of the non-solvent polyurethane system."

Unless otherwise identified, the molecular weight of each component or polymer means a weight-average molecular weight.

Unless otherwise identified, the temperature refers to room temperature and the pressure refers to ambient pressure.

The present invention provides an embossable non-solvent polyurethane sheet, which is formed from non-solvent polyurethane system comprising a polyol component (a) and an isocyanate component (b), wherein the polyol component (a) comprises (a-1) at least one polyol having a functionality in the range of from 1.5 to 2.5 and (a-2) optionally at least one polyol having a functionality in the range of 2.7 to 3.5; wherein the amount of polyol (a-2) is ≤6 wt %, based on the total weight of the polyol component (a); wherein the polyol component (a) has an average functionality of from 1.5 to 2.1.

In the present invention, the non-solvent polyurethane system for producing the embossable non-solvent polyurethane sheet consist of a polyol component (a), an isocyanate component (b), chain extender and/or crosslinking agent (c), and optionally, foamer (d), a catalyst (e), filler (f) and additives and/or auxiliaries (g), such as pigments, thickener, wetting agent and antioxidants.

Polyol Component (a)

In the present invention, the polyol component (a) comprises (a-1) at least one polyol having a functionality in the range of from 1.5 to 2.5.

The polyol used as polyol (a-1) is selected from polyols having a functionality in the range of from 1.5 to 2.5, preferably a functionality in the range of from 1.5 to 2.1.

The polyols used as polyol (a-1) preferably has a weight-average molecular weight in the range of from 500 g/mol to 10000 g/mol, preferably from 800 g/mol to 6000 g/mol, more preferably from 900 g/mol to 4000 g/mol and OH value in the range of from 20 to 400 mgKOH/g, preferably from 20 to 300 mgKOH/g, more preferably from 20 to 200 mgKOH/g.

The polyol (a-1) can be a single polyol or a mixture of at least two single polyol. Preferably, the polyol (a-1) is a mixture of at least two single polyol. Preferably, a polyether polyol mixture is use as polyol (a-1).

The suitable polyether polyols preferably have a weight-average molecular weight in the range of from 850 g/mol to 1500 g/mol, preferably from 900 g/mol to 1200 g/mol, have functionality in the range of from 1.9 to 2.1, and have OH value in the range of from 50 to 400 mgKOH/g, preferably 100 to 200 mgKOH/g. Those polyether polyol can be polyether polyol obtained by ring-opening polymerization of oxygen-containing heterocyclic compounds comprising 3 to 6 carbon atoms, such as tetrahydrofuran. Preferably, the polyol is produced by polymerizing tetrahydrofuran as repeating unit, preferably capped with primary hydroxyl.

The used polyether polyols also preferably have a weight-average molecular weight in the range of from 3000 g/mol to 4000 g/mol, preferably from 3200 g/mol to 3600 g/mol, have functionality in the range of from 1.5 to 2.0, and have OH value in the range of from 20 to 200 mgKOH/g, preferably 20 to 60 mgKOH/g. Those polyether polyols can be polyether polyol obtained by homopolymerization of diols, such as propylene glycol, ethylene glycol or Butanediol, or polyether polyols are produced by polymerizing epoxides, such as ethylene oxide and/or propylene oxide, as repeating unit and using propylene glycol as starter, preferably capped by ethylene oxide with primary hydroxyl group.

In a preferable embodiment according to the present invention, the polyol (a-1) comprises the mixture of the above polyether polyol deriving from tetrahydrofuran and the above polyether polyol deriving from epoxides, in a weight ratio of 1:1.5-3, preferably 1:1.5-2.5.

The polyols used as polyol (a-1) in the present invention are produced by known processes or can be commercially available.

In the present invention, the polyol component (a) further comprises (a-2) at least one polyol having a functionality in the range of 2.7 to 3.5; wherein the amount of polyol (a-2) is ≤6 wt %, based on the total weight of the polyol component (a).

In a preferable embodiment according to the present invention, the amount of polyol (a-2) is in the range of from 0 wt % to 4 wt %, preferably 0 wt % to 3.5 wt %, more preferably 0.5 wt % to 3.0 wt %, especially 1.0 wt % to 3.0 wt %, each based on the total weight of the polyol component (a).

The polyol (a-2) is selected from a polyol having a functionality in the range of 2.7 to 3.5, or the mixture of such polyols. The polyols used as polyol (a-2) preferably has functionality in the range of from 2.7 to 3.0.

The polyols used as polyol (a-2) preferably have a weight-average molecular weight in the range of from 3000 g/mol to 6000 g/mol, preferably from 3500 g/mol to 5000 g/mol, more preferably from 4000 g/mol to 4500 g/mol, and have OH value in the range of from 20 to 200 mgKOH/g, preferably from 20 to 100 mgKOH/g, more preferably from 25 to 60 mgKOH/g.

The polyol (a-2) can be a single polyol or a mixture of single polyols, preferably polyether polyol, more preferably polyether polyol based on epoxide, such as ethylene oxide (EO), propylene oxide (PO), and/or butane oxide (BO). Those polyether polyols can be polyether polyol produced by polymerizing epoxides, such as ethylene oxide and/or propylene oxide, as repeating unit and using glycerol as starter, preferably capped by ethylene oxide with primary hydroxyl group. The polyols used as polyol (a-2) in the invention are produced by known processes or can be commercially available.

In the present invention, the polyol component (a), which consists of (a-1) polyol and optionally (a-2) polyol, has an average functionality (FAv) of from 1.5 to 2.1. Preferably, the polyol component (a) has an average functionality of from 1.8 to 2.0, more preferably from 1.9 to 2.0, especially from 1.9 to 1.97, especially to 1.9 to 1.96 or 1.9 to 1.95.

In the present invention, FAv means the Fn average of multiple polyols contained in polyol component (a), and represents by the following formula:

$$FAv = MR1 * F1 + MR2 * F2 + MR3 * F3 + \ldots ,$$

wherein MR1 is the mole ratio of the first polyol in polyol component (a) and F1 is the functionality of the first polyol in polyol component (a); MR2 is the mole ratio of the second polyol in polyol component (a) and F2 is the functionality of the second polyol in polyol component (a) . . .

In the present invention, the molecular weights of each component were determined use gel permeation chromatography (GPC), according to GB/T 21863-2008.

In the present invention, the OH values of each polyol component were determined in accordance with DIN 53240.

In the present invention, the functionality (Fn) means number of terminal hydroxyl groups per polyol molecule. The functionality is determined by the following formula:

$$F_n = M_n^*(OHv)/56100$$

wherein Mn represents number-average molecular weight of a polyol and OHv represents OH values of polyol component.

It has been surprisingly found in this invention that the composition of polyol component (a) has important influence on the properties of the inventive non-solvent polyurethane sheet. The polyol component (a) having an average functionality (FAv) of from 1.5 to 2.1, preferably from 1.9 to 2.0, more preferably from 1.9 to 1.97, especially to 1.9 to 1.96 or 1.9 to 1.95, leads to excellent properties of the inventive non-solvent polyurethane sheet, especially texture duplicate, such as more than 55%. In particular, by using the above specific polyol (a-1) and polyol (a-2), the inventive non-solvent polyurethane sheet shows excellent properties, such as texture duplicate, peel strength, curing property and/or flexing endurance. The inventors have found that the types and amounts of polyol (a-1) and polyol (a-2) have significant influence on the above properties of the inventive non-solvent polyurethane sheet. Specifically, based on the total weight of the polyol component (a), the amount of polyol (a-2) having a functionality in the range of 2.7 to 3.5 of ≤6 wt % is favorable for the non-solvent polyurethane sheet to achieve the above improved properties, i.e., more than 55% of excellent texture duplicate, while ensuring excellent peel strength, curing property and flexing endurance. If the amount of polyol (a-2) is greater than 6 wt %, the texture duplicate is decreased. Preferably, the amount of polyol (a-2) is in the range of from greater than 0 wt % to 4 wt %, preferably 1 wt % to 3 wt %, each based on the total weight of the polyol component (a).

Isocyanate Component (b)

In the present invention, the isocyanate component (b) comprises at least one isocyanate, i.e., (b-1) isocyanate. Isocyanates used for producing the base coat layer of the invention comprise all isocyanates known for producing polyurethanes. These comprise aliphatic, cycloaliphatic, araliphatic and/or aromatic isocyanates, such as tri-, tetra-, penta-, hexa-, hepta- and/or octamethylene diisocyanate, 2-methylpentamethylene 1,5-diisocyanate, 2-ethylbutylene 1,4-diisocyanate, pentamethylene 1,5-diisocyanate, butylene 1,4-diisocyanate, 1-isocyanato-3,3,5-trimethyl-5-isocyanatomethylcyclohexane (isophorone diisocyanate, IPDI), 1,4- and/or 1,3-bis(isocyanatomethyl)cyclohexane (HXDI), cyclohexane 1,4-diisocyanate, 1-methylcyclohexane 2,4- and/or 2,6-diisocyanate and/or dicyclohexylmethane 4,4'-, 2,4'- and 2,2'-diisocyanate, diphenylmethane 2,2'-, 2,4'- and/or 4,4'-diisocyanate (MDI), polymeric MDI, naphthylene 1,5-diisocyanate (NDI), tolylene 2,4- and/or 2,6-diisocyanate (TDI), 3,3'-dimethyl diphenyl diisocyanate, 1,2-diphenylethane diisocyanate and/or phenylene diisocyanate. Particular preference is given to using diphenylmethane 2,2'-, 2,4'- and/or 4,4'-diisocyanate, and polymeric MDI, especially diphenylmethane 4,4'-diisocyanate.

The amount of isocyanate component (b) is selected such that the isocyanate index is 100-140, preferably 100-120.

The isocyanate component (b) also may comprises (b-2) at least one polyol.

The polyol (b-2) is selected from a polyol having a functionality in the range of from 1.5 to 2.5, or the mixture of such polyol. The polyols used as polyol (b-2) preferably has functionality in the range of from 1.6 to 2.0.

The polyols used as polyol (b-2) preferably has a weight-average molecular weight in the range of from 500 g/mol to 5000 g/mol, preferably from 800 g/mol to 3000 g/mol, more preferably from 1000 g/mol to 2500 g/mol and OH value in the range of from 20 to 300 mgKOH/g, preferably from 20 to 150 mgKOH/g, more preferably from 30 to 100 mgKOH/g.

The polyol (b-2) can be a single polyol or a mixture of single polyols. Preferably, a polyol mixture, especially polyether polyol mixture, is use as polyol (b-2).

The used polyether polyols preferably have a weight-average molecular weight in the range of from 1000 g/mol to 2500 g/mol, preferably from 1800 g/mol to 2300 g/mol, have functionality in the range of from 1.9 to 2.1, and have OH value in the range of from 20 to 200 mgKOH/g, preferably from 30 to 100 mgKOH/g. Those polyether polyol can be polyether polyol obtained by ring-opening polymerization of oxygen-containing heterocyclic compounds comprising 3 to 6 carbon atoms, such as tetrahydrofuran. Preferably, the polyol is produced by polymerizing tetrahydrofuran as repeating unit, preferably capped with primary hydroxyl.

The used polyether polyols also preferably have a weight-average molecular weight in the range of from 1000 g/mol to 3000 g/mol, preferably from 1500 g/mol to 2500 g/mol, and has functionality in the range of from 1.8 to 2.0, and have OH value in the range of from 20 to 200 mgKOH/g, preferably from 30 to 100 mgKOH/g. Those polyether polyols can be polyether polyol produced by polymerizing epoxides, such as ethylene oxide and/or propylene oxide, as repeating unit and using propylene glycol as starter, preferably capped by propylene glycol.

In a preferable embodiment according to the present invention, the polyol (b-2) comprises the mixture of the above polyether polyol derived from tetrahydrofuran and the above polyether polyol derived from epoxides, in a weight ratio of 1:0.5-2, preferable 1:0.8-1.5.

The polyols used as polyol (b-2) in the invention are produced by known processes or can be commercially available.

In a preferable embodiment according to the present invention, the isocyanate component (b) may comprise additives to improve the properties, such as Oxydiethylene bis(chloroformate) (DECF). The amount of the additives is preferably from 0.005 to 0.5% by weight, more preferably from 0.01 to 0.1% by weight, based on the total weight of the isocyanate component (b).

Chain Extender and/or Crosslinking Agent (c)

Chain extenders and/or crosslinking agents (c) that can be used are substances having a molar mass which is preferably smaller than 500 g/mol, particularly preferably from 60 to 400 g/mol, wherein chain extenders have 2 hydrogen atoms reactive toward isocyanates and crosslinking agents have 3 hydrogen atoms reactive toward isocyanate. These can be used individually or preferably in the form of a mixture. It is preferable to use diols and/or triols having molecular weights smaller than 500, particularly from 60 to 400, and in particular from 60 to 350. Examples of those that can be used are aliphatic, cycloaliphatic, and/or araliphatic diols having from 2 to 14, preferably from 2 to 10, carbon atoms, e.g. ethylene glycol, 1,3-propanediol, 1,4-butanediol, 1,6-hexanediol, 1,10-decanediol, 1,2-, 1,3-, and 1,4-dihydroxycyclohexane, diethylene glycol, dipropylene glycol, tripropylene glycol, diethanolamine, or triols, e.g. 1,2,4- or 1,3,5-trihydroxycyclohexane, glycerol, and trimethylolpropane. Preference is given to using ethylene glycol, 1,3-propanediol, or 1,4-butanediol, especially 1,4-butanediol.

The amount of chain extender and/or crosslinking agent c) is preferably from 0.5 to 5% by weight, more preferably from 1.5 to 4.5% by weight, based on the total weight of polyol component (a).

Blowing Agent (d)

The system also may comprise blowing agent (d). Suitable blowing agents (d) are known as such to those skilled in the art and are selected, for example, from the group consisting of carbon dioxide, alkanes such as propane, isobutane and pentane, alcohols such as methanol, 1-propanol, 2-propanol, 1-butanol, 2-butanol, 2-methylpropanol and tert-butanol, ethers such as dimethyl ether, ketones such as acetone or methyl ethyl ketones, halogenated hydrocarbons such as hydrofluoropropene, water, nitrogen and mixtures of these. Preferably, water is used as the sole blowing agent.

The amount of blowing agent (d) is preferably from 0.1 to 5% by weight, more preferably from 0.1 to 1.0% by weight, based on the total weight of polyol component (a).

Catalyst (e)

As catalyst (e), it is possible to use all compounds which accelerate the isocyanate-polyol reaction. Such compounds are known and are described, for example, in "Kunststoffhandbuch, volume 7, Polyurethane", Carl Hanser Verlag, 3rd edition 1993, chapter 3.4.1. These comprise amine-based catalysts and catalysts based on organic metal compounds, or the mixture of thereof.

As catalysts based on organic metal compounds, it is possible to use, for example, organic tin compounds such as tin(II) salts of organic carboxylic acids, e.g. tin(II) acetate, tin(II) octoate, tin(II) ethylhexanoate and tin(II) laurate, and the dialkyltin(IV) salts of organic carboxylic acids, e.g. dibutyltin diacetate, dibutyltin dilaurate, dibutyltin maleate and dioctyltin diacetate, and also Zn salts or Bi salts, e.g. Zinc octoate, bismuth(III) neodecanoate, bismuth 2-ethylhexanoate and bismuth octanoate, or alkali metal salts of carboxylic acids, e.g. potassium acetate or potassium formate.

As amine-based catalysts, it is possible to use, for example, strongly basic amines such as N,N,N-triethylaminoethoxyethanol, bis(N,N-dimethylaminoethyl)ether, dimethyl cyclohexylamine, trimethyl hydroxyethyl ethylenediamine, dimethylbenzylamine, triethylamine, triethylenediamine, pentamethyldipropylenetriamine, dimethylethanolamine, N-methylimidazole, N ethylimidazole, tetramethylhexamethylenediamine, tris(dimethylaminopropyl)hexahydrotriazine, dimethylaminopropylamine, N-ethylmorpholine, diazabicycloundecene, diazabicyclononene, diazabicyclooctane, preferably triethylenediamine or bis(N,N-dimethylaminoethyl)ether.

The catalyst (e) used in the invention can be commercially available, such as Haptex CC 6945/92 C-CC from BASF and Additive CX 93600 from BASF.

Typically, the amount of the catalyst (e) is preferably from 0.05 to 5% by weight, more preferably from 0.1 to 1.5% by weight, based on the total weight of polyol component (a).

Filler (f)

According to the present invention, filler that can be used, if present, is inorganic filler, which is selected from calcium carbonate, aluminium hydroxide, barium sulfate, or talc, preferably calcium carbonate or aluminium hydroxide. The amount of inorganic filler is from 0 to 200% by weight, preferably from 10 to 50% by weight, based on the total weight of the non-solvent polyurethane system.

Additives and/or Auxiliaries (g)

Additives and/or auxiliaries (g) that can be used comprise surfactants, preservatives, pigment, colorants, antioxidants, silicone oil leveling agent, stabilizers, thickener, wetting agent and reinforcing agents. In preparing the non-solvent polyurethane system, it is generally to employ one of above additives and/or auxiliaries, or the mixture thereof, so as to improve the properties of the obtained polyurethane sheet, such as texture duplicate, peeling strength, flexing endurance and curing property.

Typically, the amount of additives and/or auxiliaries, is preferably from 0 to 12% by weight, more preferably from 0.1 to 10% by weight, based on the total weight of the non-solvent polyurethane system.

According to the present invention, thickener, wetting agent, and antioxidant are preferably used. Those materials that can be used, if present, include all thickener, wetting agent, and antioxidant commonly used in the non-solvent polyurethane system. The amount of each of them is preferably from 0.1 to 5% by weight, more preferably from 0.5 to 1% by weight, each based on the total weight of the non-solvent polyurethane system.

Further information concerning the mode of use and of action of the abovementioned auxiliaries and additives, and also further examples, are given by way of example in "Kunststoffhandbuch, Band 7, Polyurethane" ["Plastics handbook, volume 7, Polyurethanes"], Carl Hanser Verlag, 3rd edition 1993, chapter 3.4.

The present invention further provides an embossable non-solvent PU laminate, comprising A) a top coat layer based on an aqueous polyurethane dispersion, and B) a base coat layer underneath the top coat layer, wherein the base coat layer is made of the embossable non-solvent polyurethane sheet according to the present invention.

Top Coat Layer

In the present invention, the aqueous polyurethane dispersion used in the top coat skin layer has onset decomposing temperature in the range from 150-250° C., preferably from 180-230° C., measured by TGA. Suitable aqueous polyurethane dispersion used in the top coat skin layer disclosed in, for example PCT/CN2020/084834, the contents of which are expressly incorporated herein by reference.

In the present invention, the aqueous polyurethane dispersion used in the top coat skin layer can be commercially available, such as Haptex CC 6945/90 C-CH from BASF, or is prepared from an isocyanate component (a') and a polyol component (b'). The method for preparing the aqueous polyurethane dispersion can be any method commonly used in the art and is known by those skilled in the art. The isocyanate component (a') comprises the customary aliphatic, cycloaliphatic and aromatic di- and/or polyisocyanates. Preference is given to using tolylene diisocyanate (TDI), diphenylmethane diisocyanate (MDI) and mixtures of diphenylmethane diisocyanate and polyphenylene polymethylene polyisocyanates (polymeric MDI), and especially diphenylmethane diisocyanate (monomeric MDI).

Isophorone diisocyanate (IPDI), hexamethylene diisocyanate (HDI), and hydrogenated diphenylmethane-4,4'-diisocyanate (H12MDI) are also preferable.

The isocyanates or else hereinbelow described isocyanate prepolymers may also be in a modified state, for example through incorporation of uretidione, carbamate, isocyanurate, carbodiimide or allophanate groups. It is further possible to use blends of the various isocyanates.

The polyisocyanates may also be employed in the form of polyisocyanate prepolymers. These prepolymers are known in the prior art. They are prepared in a conventional manner by reacting above-described polyisocyanates with hereinbelow described compounds having isocyanate-reactive hydrogen atoms to form the prepolymer. The reaction may for example be carried out at temperatures of about 80° C. The polyol/polyisocyanate ratio is generally chosen such that the NCO content of the prepolymer is in the range from 6% to 25% by weight.

The polyol component (b') preferably comprises polyetherols and/or polyesterols. These are commonly known and described for example in "Kunststoffhandbuch Polyurethane" Günter Oertel, Carl-Hanser-Verlag, 2nd edition 1983, chapter 3.1.1. Alternative designations likewise customary in the pertinent art are polyether polyols or polyether alcohols on the one hand and polyester polyols or polyester alcohols on the other hand.

In the present application, preferably, the polyol component (b') is a polyol mixture. The polyol component (b') comprises (b'-1) a polyol having a weight-average molecular weight in the range of from 500 g/mol to 10000 g/mol, and functionality in the range of from 2 to 4, and (b'-2) a polyol having a weight average molecular weight in the range of from 500 g/mol to 3000 g/mol, and functionality in the range of from 2 to 4. By way of example, polyol (b'-1) may be polyester, such as XCP-2000N and polyol (b'-2) may be polyether, preferably hydrophilic polyether based on polyethylene glycol, such as Ymer N120.

The polyol component (b') also comprises (b'-3) a chain extender having a molecular weight of less than 400 g/mol, and (b'-4) a hydrophilic chain extender containing carboxylate group or sulphonate group.

Chain extender (b'-3) that may be used are substances having a molar mass which is preferably smaller than 400 g/mol, particularly preferably from 60 to 400 g/mol, wherein chain extenders have at least 2 hydrogen atoms reactive toward isocyanates. These may be used individually or preferably in the form of a mixture. It is preferable to use diols and/or triols having molecular weights from 60 to 400, and in particular from 60 to 350. Examples of those that may be used are aliphatic, cycloaliphatic, and/or araliphatic diols having from 2 to 10 carbon atoms, e.g. ethylene glycol, 1,3-propanediol, 1,4-butanediol, 1,6-hexanediol, 1,10-decanediol, 1,2-, 1,3-, and 1,4-dihydroxycyclohexane, diethylene glycol, dipropylene glycol, tripropylene glycol, diethanolamine, or triols, e.g. 1,2,4- or 1,3,5-trihydroxycyclohexane, glycerol, and trimethylolpropane. It is also preferable to use diamine and/or triamine. Examples of those that may be used are diethylenetriamine or N-(2-Hydroxyethyl) ethylenediamine. The amount of chain extender (b'-3), based on the total solid weight of the aqueous polyurethane dispersion, is preferably from 0.1 to 10% by weight, particularly preferably from 0.2 to 8% by weight.

Hydrophilic chain extenders (b'-4) that may be used are hydrophilic chain extenders with carboxyl group or sulphonate group. They provide hydrophilic groups for the aqueous polyurethane dispersion to ensure that the dispersion has an appropriate hydrophilicity. Preferably, AB-salt (Sodium 2-[(2-aminoethyl)amino]ethanesulphonate) or DMPA (dimethylolpropionic acid) may be used here. The amount of hydrophilic chain extenders (b'-4), based on the total solid weight of the aqueous polyurethane dispersion, is preferably from 0.1 to 50% by weight, particularly preferably from 0.2 to 35% by weight.

The aqueous polyurethane dispersion contains no more than 0.5%, preferably less than 0.1% of carboxylate group, based on the total solid weight of the aqueous polyurethane dispersion, wherein the carboxylate group derives from hydrophilic extenders with carboxyl group as well as other carboxyl-containing starting materials which are used to prepare the aqueous polyurethane dispersion. Additionally, the molar ratio of hydroxyl and/or amino group to the isocyanate group present in the aqueous polyurethane dispersion is 0.9 to 1.5, preferably 1.10 to 1.25.

The aqueous polyurethane dispersion optionally contains an amine neutralization agent with gel reactivity, so as to provide suitable pH range of 6-9 for the dispersion. The amount of amine neutralization agent, based on the total solid weight of the aqueous polyurethane dispersion, is preferably from 0.01 to 5% by weight, particularly preferably from 0.05 to 2% by weight. By way of example, the amine neutralization agent is selected from the group consisting of triethylenediamine (TEDA), 1,2-dimethylimidazole, N,N-dimethylcyclohexylamine, N,N,N',N'-Tetramethylethylenediamine and tertiaryamine.

Optionally, the aqueous polyurethane dispersion contains surfactants. The surfactants may be nonionic, such as alcohol ethoxylates, alkyl polyglucosides, Bisphenol A ethoxylates, ethoxylated natural fat/oil, fatty acid ethoxylates, or/and anionic surfactants, such as fatty alcohol ethersulfates, fatty alcohol sulfates, linear alkylbenzene sulphonates, oleic acid sulphonates, di-isodecyl sulfosuccinate, alkyl ether phosphate, alkyl ether carboxylates, or/and cationic surfactants, such as amine ethoxylates, aminopolyol, quaternary ammonium surfactants.

In a preferable embodiment of the invention, the top coat skin layer based on an aqueous polyurethane dispersion also contains crosslinker. Here, suitable crosslinker may be selected from aromatic-or aliphatic-polycarbodiimide (PCDI) with or without hydrophilic modification, or isocyanate. The crosslinker may be used in a mixed or single manner, preferable in a mixed manner. By way of example, Astacin Hardener CA and/or Astacin Hardener CI may be used as the crosslinker. The amount of the crosslinker, based on the total solid weight of the aqueous polyurethane dispersion, is preferably from 0.1 to 20% by weight, particularly preferably from 0.5 to 15% by weight, and in particular from 1 to 10% by weight.

In a preferable embodiment of the invention, the top coat skin layer based on an aqueous polyurethane dispersion also contains other additives and/or auxiliaries which are commonly known by those skilled in the art. The additives and/or auxiliaries that may be used comprise surfactants, thickener, pigment, colorants, antioxidants, reinforcing agents, stabilizers and wetting agent. In preparing polyurethane dispersion, it is generally to employ one of above additives and/or auxiliaries, or the mixture thereof, so as to improve the properties of the obtained polyurethane dispersion. Typically, the amount of other additives and/or auxiliaries is preferably from 0 to 25% by weight, more preferably from 0.5 to 15% by weight, based on the total solid weight of the aqueous polyurethane dispersion. Here, as pigment, it is possible to use all compounds which are suitable for preparing polyurethane dispersion, such as Permutex PP-39-611. The amount of pigment, if present, based on the total solid weight of the aqueous polyurethane dispersion, is preferably from 1 to 12% by weight, particularly preferably from 5 to 10% by weight. As thickener, it is possible to use all compounds which are commonly used for preparing polyurethane dispersion, such as Permutex RM 4456. The amount of thickener, if present, based on the total solid weight of the aqueous polyurethane dispersion, is preferably from 0.1 to 8% by weight, particularly preferably from 0.5 to 5% by weight. As wetting agent, it is possible to use all compounds which are commonly used for preparing polyurethane dispersion, such as BYK 348. The amount of wetting agent, if present, based on the total solid weight of the aqueous polyurethane dispersion, is preferably from 0.1 to 5% by weight, particularly preferably from 0.3 to 3% by weight. As antioxidant, it is possible to use all compounds which are suitable for preparing polyurethane dispersion. The amount of antioxidant, if present, based on the total solid weight of the aqueous polyurethane dispersion, is preferably from 0.1 to 5% by weight, more preferably from 0.5 to 1% by weight.

Base Coat Layer

In the present invention, the base coat layer is made of the embossable non-solvent polyurethane sheet according to the present invention. The embossable non-solvent polyurethane sheet is formed from non-solvent polyurethane system as defined above.

The present invention further provides a synthetic leather which comprising the laminate as defined above and a substrate layer, wherein the substrate layer is underneath the base coat layer of the laminate. The top coat layer and the base coat layer are as defined above. The substrate layer is obtained as follows:

Substrate Layer

In the present application, the synthetic leather comprises a substrate layer underneath the base coat layer. In principle, the substrate layer may be any layer capable of forming an adhering bond with the base coat layer. The thickness of the substrate layer is typically in the range from 0.01 mm to 20 mm, preferably in the range from 0.1 mm to 15 mm. The substrate layer is selected from, for example, non-woven fabric, textile, TPU, genuine leather, wood, plastic or split leather. One preferred embodiment utilizes non-woven fabric or split leather as the substrate layer.

The laminate according to the invention has improved texture duplicate, as well as instant peel strength, curing property and/or flexing endurance. The present inventive laminate may be used in apparel and accessories as an upper material for handbags, shoes, boots, gloves, hats or outerwear items like jackets, pants and belts. It could also be used as covering materials for cases and electronic devices, such as suitcases, briefcases, watch bands, smartphone cases, earphone cases and camera cases. In furniture/upholstery area, the present laminate could be used as synthetic leather coverings for sofas, car seats, car interiors, chairs, cushion and coffee tables, and in certain types of decorations such as wall hangings. Besides, the present inventive laminate could also be used in sports items or leisure products, like game balls, saddles, toys etc. In another aspect, the present laminate could be used in anywhere as a replacement of genuine leather.

The PU sheet/laminate/leather can be processed by many ways, for examples:

The PU sheet/laminate/leather is continuously embossed by a hot embossing roller with the temperature of 150-250° C., and then the texture/pattern is duplicated.

The PU sheet/laminate/leather is heated to desired temperature, such as 150-250° C., then the leather is continuously embossed by the embossing roller without heater.

The PU sheet/laminate/leather is heated to the desired temperature, such as 150-250° C., then leather continuously sucked by the vacuum embossing roller that has tiny hollows and textured surface.

The PU sheet/laminate/leather is embossed by a hot plat plate (150-250° C.), and not a continuous way like the embossing roller.

The PU sheet/laminate/leather is pressed by a hot stamper or plate (150-250° C.) with the designed brand logo or character in a very short time.

EXAMPLES

The present invention will now be described with reference to Examples and Comparative Examples, which are not intended to limit the present invention.

The following raw materials were used:

Polyol #1 is produced by polymerizing tetrahydrofuran as repeating unit, and capped with primary hydroxyl, with a functionality of 2, and hydroxyl number (OHv) of 112.3 mgKOH/g.

Polyol #2 is produced by polymerizing ethylene oxide as repeating unit and using propylene glycol as starter, and capped by ethylene oxide with primary hydroxyl groups, with a functionality of 1.76, and hydroxyl number (OHv) of 29.5 mgKOH/g.

Polyol #3 is produced by polymerizing ethylene oxide as repeating unit and using glycerol as starter, and capped by ethylene oxide with primary hydroxyl groups, with a functionality of 2.72, and hydroxyl number (OHv) of 35 mgKOH/g.

Polyol #4 is produced by polymerizing propylene oxide as repeating unit and using TDA as starter, and capped by propylene oxide, with a functionality of 4, and hydroxyl number (OHv) of 405 mgKOH/g.

Polyol #5 is produced by polymerizing propylene oxide as repeating unit and using propylene glycol as starter, and capped by propylene glycol, with a functionality of 2, and hydroxyl number (OHv) of 55 mgKOH/g.

Polyol #6 is produced by polymerizing tetrahydrofuran as repeating unit, and capped with primary hydroxyl, with a functionality of 2, and hydroxyl number (OHv) of 56.1 mgKOH/g.

Haptex CC 6945/90 C-CH is water based PUD with solid content 34.5% from BASF.

ADDITIVE DECF is Polymerization inhibitor from BASF.

Permutex PP-39-611 is Pigment Black with solid content 20.0% from Stahl.

Permutex RM 4456 is a thickener with solid content 28.0% form Stahl.

BYK 348 is a wetting agent with 100% solid content form BYK.

Astacin Hardener CI is a crosslinker with 70.0% solid content from BASF.

Astacin Hardener CA is a crosslinker with 60.0% from BASF.

Lupranate MS is an isocyanate from BASF.

Additive CX 93600 is a catalyst from BASF.

Haptex CC 6945/92 C-CC is a catalyst from BASF.

Favini B100 is release paper from Favini.

Preparation of Top Coat Layer

The following components were used to prepare top coat layer:

TABLE 2

Formulation of top coat layer (part by weight)

| | Comp. Exp. 1-2 and Exp. 1-4 |
|---|---|
| Haptex CC 6945/90 C-CH | 100 |
| Permutex PP-39-611 | 10 |
| Permutex RM 4456 | 2.5 |
| Astacin Hardener CI | 3 |
| Astacin Hardener CA | 1 |
| BYK 348 | 0.5 |

Preparation of Non-Solvent Polyurethane Sheet as Base Coat Layer

The following components were used to prepare non-solvent polyurethane sheet:

TABLE 3

Formulation of component (a) of non-solvent polyurethane system (part by weight)

| component (a) | #1 | #2 | #3 | #4 | #5 | #6 |
|---|---|---|---|---|---|---|
| Polyol #1 | 30 | 30 | 30 | 30 | 30 | 30 |
| Polyol #2 | 56 | 60 | 63 | 65 | 60 | 66 |
| Polyol #3 | 10 | 6 | 3 | 1 | 0 | 0 |
| Polyol #4 | 0 | 0 | 0 | 0 | 6 | 0 |
| BDO | 3.8 | 3.8 | 3.8 | 3.8 | 3.8 | 3.8 |
| Water | 0.2 | 0.2 | 0.2 | 0.2 | 0.2 | 0.2 |
| Total weight | 100 | 100 | 100 | 100 | 100 | 100 |
| FAv of component (a) | 1.98 | 1.97 | 1.96 | 1.96 | 2.38 | 1.95 |

TABLE 4

| Formulation of component (b) of non-solvent polyurethane system (part by weight) | | | | |
|---|---|---|---|---|
| components | Polyol #5 | Polyol #6 | Lupranate MS | Additive DECF |
| Total 100 wt % | 18.99 wt % | 20 wt % | 61 wt % | 0.01 wt % |

TABLE 5

| Formulation of non-solvent polyurethane system (part by weight) | | | | | | |
|---|---|---|---|---|---|---|
| | Comp. Exp. 1 | Exp. 1 | Exp. 2 | Exp. 3 | Comp. Exp. 2 | Exp. 4 |
| #1 | 100 | | | | | |
| #2 | | 100 | | | | |
| #3 | | | 100 | | | |
| #4 | | | | 100 | | |
| #5 | | | | | 100 | |
| #6 | | | | | | 100 |
| component (b) | 46.4 | 46.3 | 46.3 | 46.2 | 54.9 | 46.2 |
| Additive CX 93600 | 0.1 | 0.1 | 0.1 | 0.1 | 0.1 | 0.1 |
| Haptex CC 6945/92 C-CC | 0.4 | 0.4 | 0.4 | 0.4 | 0.4 | 0.4 |

Preparation of Laminates

Example 1

Preparation of Laminates Comprising of the Top Coat Skin Layer and the Base Coat Layer Formulations in Table 2 were prepared by blending the ingredients by sequence, and then were applied with a thickness of 100 μm within 4 hours by knife coating on a Favini B100 release paper, followed by drying in Oven #1 at 80° C. for 2 min and at 120° C. for 2 min. Next, the formulation in Table 5 were prepared by blending the ingredients by sequence, and then applied with a thickness of 350 μm by knife coating on top of the dried top coat formulation, and heated in Oven #2 at 120-140° C. for 5-10 min, to form a base coat layer. Then, the resulting laminate was separated from the release paper to obtain a final laminate product.

Processing refers to FIG. 1.

Example 2

Preparation of PU Synthetic Leather Comprising of the Top Coat Layer, the Base Coat Layer and the Substrate Layer Formulations in Table 2 were prepared by blending the ingredients by sequence, and then were applied with a thickness of 100 μm by knife coating within 4 hours onto a Favini B100 release paper, followed by drying in Oven #1 at 80° C. for 2 min and at 120° C. for 2 min. Next, the formulation in Table 5 were prepared by blending the ingredients by sequence, and then was applied with a thickness of 350 μm by knife coating on top of the dried top coat formulation, and heated in Oven #2 at 120-140° C. for 5-10 min. Then, a substrate layer was applied on the dried base coat layer, and heated in Oven #3 at 140° C. for 2-10 min, followed by pressing. PU synthetic leather was obtained after stripping the release paper.

Figure 2:
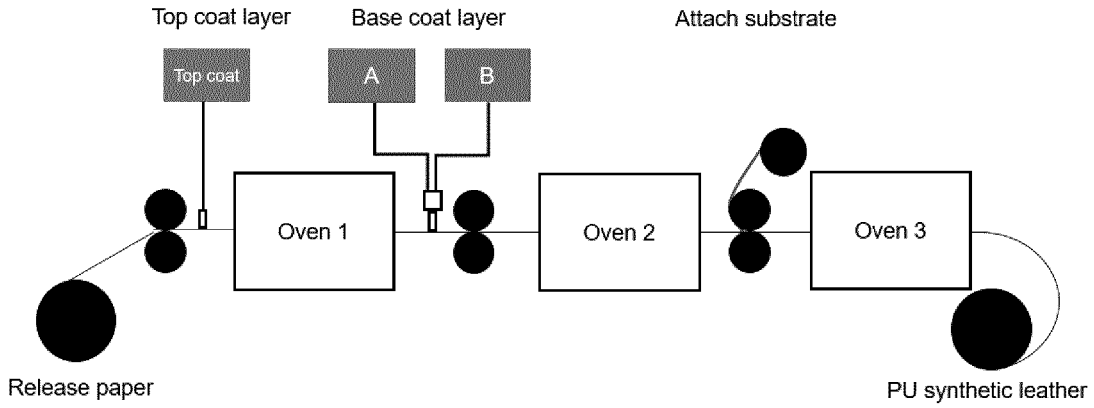
FIG. 2 shows the process for preparing non-solvent PU synthetic leather.

Processing refers to FIG. 2.

Properties Tests of the PU Synthetic Leather

Peeling Strength Test

Peeling strength test was carried out to the PU artificial leathers that were just peeled from the release paper after curing, and the testing should be finished within 20 min, including specimen preparation and testing. The test follows the standard SATRA™ 411.

Curing Property

Curing property of 2-component PU layer was evaluated by using nail to press the top coat of the laminate (the PU synthetic leather) and then visually evaluating according to the following grades:

Grade 1: nail print is rebound>10 sec, or the top coat is damaged

Grade 2: nail print rebound (7 sec-9 sec);

Grade 3: nail print rebound (4 sec-6 sec);

Grade 4: nail print rebound (1 sec-3 sec);

Grade 5: no obvious nail print

Flexing Endurance Test

Flexing endurance test was carried out according to the standard ISO 5402 as follows:

Test pieces of the PU synthetic leather were prepared according to ISO 2418, including cutting at least three Vertical test pieces and at least three Horizontal test pieces, conditioning the test pieces according to ISO 2419 and performing the test in conditioned atmosphere. After 25× magnification, the test pieces were visually evaluated in terms of the cracks/loss of adhesion/change of color shade. The expression "pass" indicates no visible cracks/loss of adhesion/visible change of color shade. The expression "fail" means there is damage on the test pieces.

Embossing Property (Texture Duplicate):

Embossing property test was carried out as follows:

The embossing machine is Model 380 (Nanjing Yueyi Clothing Co. Ltd) assembled with tailor-made embossing plat. The embossing process is as follows:

(1) Setting the temperature to 170° C., and waiting until the embossable plate keeps a constant temperature;

(2) Setting embossing/pressing time to 40 sec;

(3) Placing the leather sample on the console, pressing the pressure button first, and then pressing the operation button with both hands. Once the time is reached, the embossing plate automatically moves up, and then the sample can be taken out.

Figure 3:
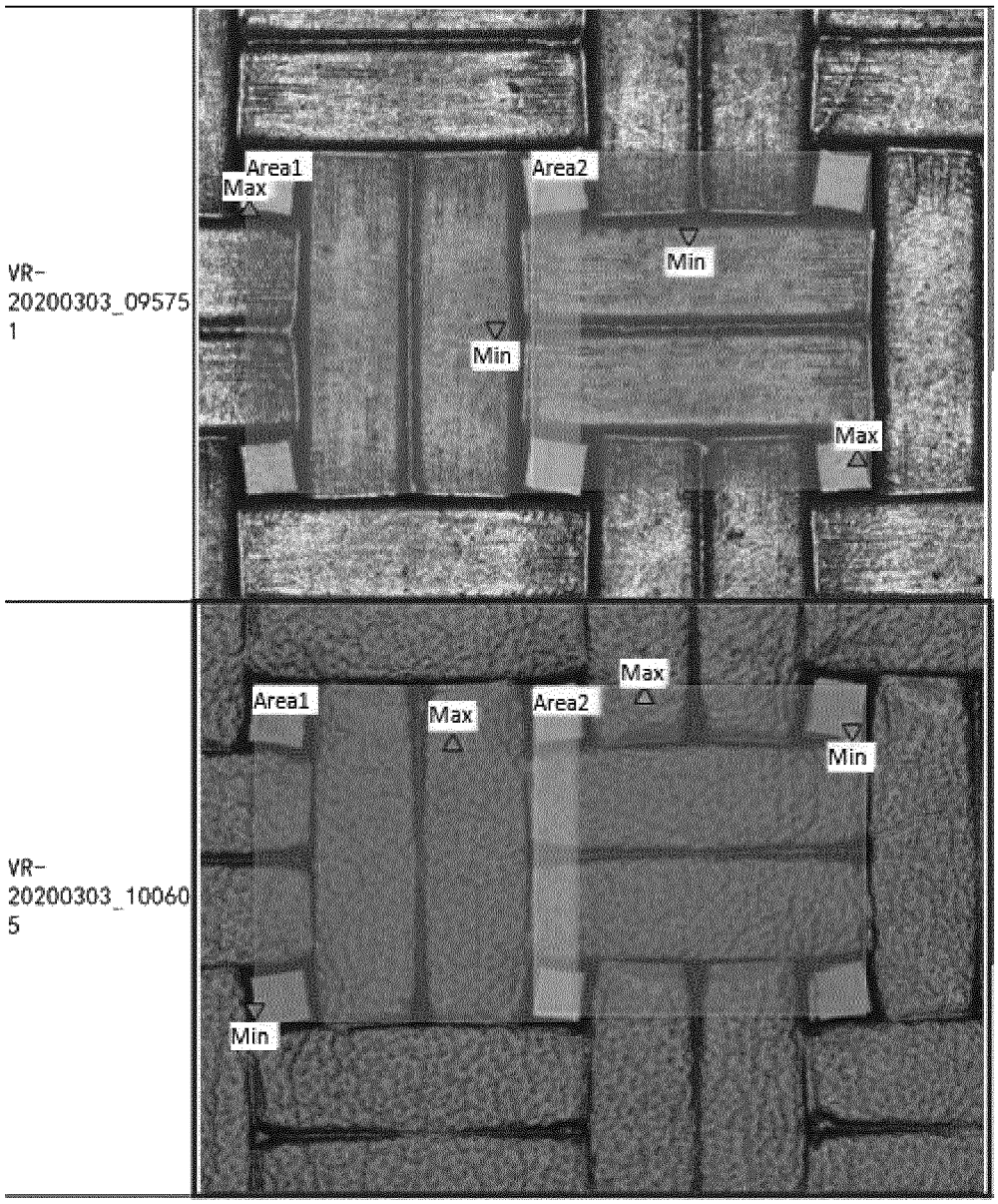
FIG. 3 shows the texture duplicate on the preparing non-solvent PU synthetic leather.

3D Profile Meter measuring system (Model: VR-3200) was used to measure 1) the height difference of the embossing plate (ΔHa), and 2) the height difference of the laminates embossed with the plate (ΔHb) (see FIG. 3). The ratio of ΔHb/ΔHa is expressed as percentage to indicate how much percentage of the laminate copies the pattern of the embossing plate. ΔHb=ΔHa means 100% reproduction of the pattern of the embossing plate.

TABLE 6

Test result of the PU synthetic leathers comprising a top coat layer, a base coat layer and a substrate layer

| | Comp. Exp. 1 | Exp. 1 | Exp. 2 | Exp. 3 | Comp. Exp. 2 | Exp. 4 |
|---|---|---|---|---|---|---|
| ΔHa (Embossing plate) | 1.45 | 1.45 | 1.45 | 1.45 | 1.45 | 1.45 |
| ΔHb (PU Leather) | 0.7 | 0.86 | 0.96 | 1.05 | 0.25 | 1.26 |
| Texture/grain duplicate % | 48.3 | 59.3 | 66.2 | 72.4 | 17.2 | 86.9 |
| Peel strength [kg/cm] | 2.4 | 2.4 | 3.1 | 3.1 | 1.3 | 3.2 |
| Curing property | Grade 5 | Grade 5 | Grade 5 | Grade 5 | Grade 5 | Grade 4 |
| Flexing/25° C., 100k | Pass | Pass | Pass | Pass | Fail | Pass |

From the above results, it can be seen that compared with the comparative examples 1-2, the PU synthetic leathers obtained in the inventive examples 1-4 by using the inventive non-solvent polyurethane system as the base coat layer achieve significantly improved properties in terms of texture duplicate, as well as good peel strength, curing property and flexing endurance. It also can be seen that the inventive example 4, using the polyol component (a) consisting of the polyol (a-1) having an average functionality of less than 2.1, showed superb texture duplicate, good flexing endurance and peel strength, and only slightly inferior curing property; however, the comparative example 2, using the polyol component (a) consisting of the polyol (a-1) having an average functionality of 2.38, showed poor texture duplicate, flexing endurance and peel strength. The inventive examples 1-3, using the polyol component (a) consisting of the polyol (a-1) and polyol (a-2) with an amount of ≤6 wt %, showed excellent texture duplicate, together with good peel strength, curing property and flexing endurance; however, the comparative example 1, using the polyol component (a) consisting of the polyol (a-1) and polyol (a-2) with a greater amount, showed inferior texture duplicate.

The structures, materials, compositions, and methods described herein are intended to be representative examples of the invention, and it will be understood that the scope of the invention is not limited by the scope of the examples. Those skilled in the art will recognize that the invention may be practiced with variations on the disclosed structures, materials, compositions and methods, and such variations are regarded as within the ambit of the invention. Thus, it is intended that the present invention cover such modifications and variations as come within the scope of the appended claims and their equivalents.

The invention claimed is:

1. An embossable non-solvent polyurethane sheet, which is formed from a non-solvent polyurethane system comprising a polyol component (a) and an isocyanate component (b), wherein the polyol component (a) comprises (a-1) at least one polyol having a functionality in a range of from 1.5 to 2.5; and (a-2) at least one polyol having a functionality in a range of 2.7 to 3.5, wherein an amount of the at least one polyol (a-2) is in a range of from 1 wt % to 3 wt %, based on a total weight of the polyol component (a), and wherein the polyol component (a) has an average functionality of from 1.5 to 2.1.

2. The embossable non-solvent polyurethane sheet according to claim 1, wherein the at least one polyol (a-1) is a polyol mixture of at least two polyols.

3. The embossable non-solvent polyurethane sheet according to claim 1, wherein the at least one polyol (a-1) has a functionality in a range of from 1.5 to 2.1.

4. The embossable non-solvent polyurethane sheet according to claim 1, wherein the at least one polyol (a-2) has a functionality in a range of from 2.7 to 3.0.

5. The embossable non-solvent polyurethane sheet according to claim 1, wherein the polyol component (a) has an average functionality of from 1.8 to 2.0.

6. The embossable non-solvent polyurethane sheet according to claim 1, wherein at least one polyol of the at least one polyol (a-1) is selected from the group consisting of polyether polyols derived from epoxides and oxygen-containing heterocyclic compounds comprising 3 to 6 carbon atoms.

7. The embossable non-solvent polyurethane sheet according to claim 1, wherein at least one polyol of the at least one polyol (a-2) is selected from the group consisting of polyether polyols derived from epoxides.

8. The embossable non-solvent polyurethane sheet according to claim 1, wherein the isocyanate component (b) comprises (b-1) isocyanate and (b-2) at least one polyol having a functionality in a range of from 1.5 to 2.5.

9. The embossable non-solvent polyurethane sheet according to claim 8, wherein the at least one polyol (b-2) has a weight-average molecular weight in a range of from 500 g/mol to 5000 g/mol, and an OH value in a range of from 20 to 300 mgKOH/g.

10. An embossable non-solvent polyurethane (PU) laminate, comprising

A) a top coat layer based on an aqueous polyurethane dispersion; and

B) a base coat layer underneath the top coat layer, wherein the base coat layer is made of the embossable non-solvent polyurethane sheet according to claim 1.

11. The embossable non-solvent PU laminate according to claim 10, wherein the top coat layer further comprises a crosslinker with a content of from 0.5 to 10%, based on an amount of the aqueous polyurethane dispersion, wherein the crosslinker is selected from the group consisting of aromatic-or aliphatic-polycarbodiimide (PCDI) with or without hydrophilic modification, and isocyanate trimer.

12. The embossable non-solvent PU laminate according to claim 10, wherein the aqueous polyurethane dispersion has an onset decomposing temperature in a range from 150-250° C., measured by TGA.

13. A synthetic leather which comprises the embossable non-solvent PU laminate according to claim 10 and a substrate layer, wherein the substrate layer is underneath the base coat layer of the laminate.

14. A method of using the synthetic leather according to claim 13, the method comprising using the synthetic leather as an upper or covering material in an application of apparel, accessories, cases, electronic devices, furniture, auto upholstery, sports items or leisure products.

15. A method of using the laminate according to claim 10, the method comprising using the laminate as an upper or covering material in an application of apparel, accessories, cases, electronic devices, furniture, auto upholstery, sports items or leisure products.

16. The embossable non-solvent PU laminate according to claim 10, wherein the top coat layer further comprises a crosslinker with a content of from 0.5 to 5%, based on an amount of the aqueous polyurethane dispersion, wherein the crosslinker is selected from the group consisting of aromatic-or aliphatic-polycarbodiimide (PCDI) with or without hydrophilic modification, and isocyanate trimer.

17. A method of using the sheet according to claim 1, the method comprising using the sheet as an upper or covering material in an application of apparel, accessories, cases, electronic devices, furniture, auto upholstery, sports items or leisure products.

18. The embossable non-solvent polyurethane sheet according to claim 1, wherein the polyol component (a) has an average functionality of from 1.9 to 2.0.

* * * * *